US011443707B2

(12) United States Patent
Kobayashi

(10) Patent No.: US 11,443,707 B2
(45) Date of Patent: Sep. 13, 2022

(54) LIQUID CRYSTAL DISPLAY DEVICE, METHOD FOR DRIVING LIQUID CRYSTAL DISPLAY DEVICE, AND ELECTRONIC APPARATUS

(71) Applicant: SONY SEMICONDUCTOR SOLUTIONS CORPORATION, Kanagawa (JP)

(72) Inventor: Hiroshi Kobayashi, Kanagawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 16/959,483

(22) PCT Filed: Dec. 5, 2018

(86) PCT No.: PCT/JP2018/044725
§ 371 (c)(1),
(2) Date: Jul. 1, 2020

(87) PCT Pub. No.: WO2019/138740
PCT Pub. Date: Jul. 18, 2019

(65) Prior Publication Data

US 2021/0312878 A1 Oct. 7, 2021

(30) Foreign Application Priority Data

Jan. 12, 2018 (JP) ..... JP2018-003469

(51) Int. Cl.
*G09G 3/36* (2006.01)

(52) U.S. Cl.
CPC ..... *G09G 3/3614* (2013.01); *G09G 3/3607* (2013.01); *G09G 3/3677* (2013.01);
(Continued)

(58) Field of Classification Search
CPC .. G09G 3/3614; G09G 3/3611; G09G 3/3607; G09G 3/3688; G09G 3/3677;
(Continued)

(56) References Cited

U.S. PATENT DOCUMENTS 5,931,707 A * 8/1999 Ito ..... H01R 13/4368 439/752
6,198,464 B1 * 3/2001 Ota ..... G09G 3/3655 345/77
(Continued)

FOREIGN PATENT DOCUMENTS

JP H10-171422 6/1998
JP 2002-099262 4/2002
(Continued)

OTHER PUBLICATIONS

International Search Report and Written Opinion prepared by the Japanese Patent Office dated Feb. 25, 2019, for International Application No. PCT/JP2018/044725.

*Primary Examiner* — David Tung
(74) *Attorney, Agent, or Firm* — Sheridan Ross P.C.

(57) ABSTRACT

A liquid crystal display device includes: a pixel array unit in which pixels including a liquid crystal cell are arranged in a matrix; scan lines; common wiring; and data lines, in which each of the pixels includes a pixel transistor connecting the data line and the pixel electrode, a conductive state/a non-conductive state of the pixel transistor is controlled by a scan signal voltage applied to the scan line, a signal voltage whose polarity is inverted in regular cycles is supplied to the common wiring, and at least one of a pre-charge voltage supplied to the data line prior to writing of a video signal voltage or a scan signal voltage supplied to the scan line when no pixel is selected is supplied so as to vary in accordance with the position at which the pixels are selected row by row in the pixel array unit.

9 Claims, 12 Drawing Sheets

(52) U.S. Cl.
CPC ... *G09G 3/3688* (2013.01); *G09G 2320/0214* (2013.01); *G09G 2320/0238* (2013.01); *G09G 2320/0247* (2013.01)

(58) Field of Classification Search
CPC ... G09G 2320/0247; G09G 2320/0214; G09G 2320/0238
See application file for complete search history.

(56) References Cited

U.S. PATENT DOCUMENTS

| | | | | |
|---|---|---|---|---|
| 2002/0126114 | A1* | 9/2002 | Yatabe | G09G 3/3688 345/212 |
| 2004/0160404 | A1* | 8/2004 | Nakajima | G09G 3/3648 345/96 |
| 2007/0075960 | A1* | 4/2007 | Ito | G09G 3/3648 345/98 |
| 2008/0079710 | A1* | 4/2008 | Ishii | G09G 3/2096 345/215 |
| 2009/0251451 | A1* | 10/2009 | Cha | G09G 3/3614 345/211 |
| 2011/0115778 | A1 | 5/2011 | Yang et al. | |
| 2014/0313181 | A1* | 10/2014 | Hong | G09G 3/3696 345/212 |

FOREIGN PATENT DOCUMENTS

| | | |
|---|---|---|
| JP | 2009-109705 | 5/2009 |
| WO | WO 2017/134967 | 8/2017 |

* cited by examiner

LIQUID CRYSTAL DISPLAY DEVICE, METHOD FOR DRIVING LIQUID CRYSTAL DISPLAY DEVICE, AND ELECTRONIC APPARATUS

CROSS REFERENCE TO RELATED APPLICATIONS

This application is a national stage application under 35 U.S.C. 371 and claims the benefit of PCT Application No. PCT/JP2018/044725 having an international filing date of 5 Dec. 2018, which designated the United States, which PCT application claimed the benefit of Japanese Patent Application No. 2018-003469 filed 12 Jan. 2018, the entire disclosures of each of which are incorporated herein by reference.

TECHNICAL FIELD

The present disclosure relates to a liquid crystal display device, a method for driving a liquid crystal display device, and an electronic apparatus.

BACKGROUND ART

In a liquid crystal display device in which pixels including a liquid crystal cell are two-dimensionally arranged in a matrix, an image is displayed by causing a pixel to operate as an optical shutter (light valve). As a display device employing a liquid crystal display device, direct-view type display devices and projection type (projector type) display devices have been put into practical use. In recent years, not only direct-view type display devices but also projection type display devices have found extended applications including large-scale conference rooms and entertainment, demanding higher definition and higher image quality, and thus so-called active-matrix display devices have been widely used.

When a liquid crystal cell is driven by a direct current, impurities in the liquid crystal layer are unevenly accumulated and deteriorated. For this reason, AC voltage driving is used for a liquid crystal display device to drive the device by applying an AC voltage thereto. Furthermore, to reduce vertical crosstalk due to the asymmetry of current leakage in the transistor in a pixel and to reduce variations in the potential attained when a video signal voltage is supplied, there have been provided solutions including applying a voltage different from the video signal voltage to a data line (see, for example, Patent Document 1).

CITATION LIST

Patent Document

Patent Document 1: Japanese Patent Application Laid-Open No. H10-171422

SUMMARY OF THE INVENTION

Problems to be Solved by the Invention

In a case where the voltage applied to the counter electrode (common electrode) opposed to the pixel electrode is sequentially inverted to drive the device, the variation range of the voltage applied to the pixel electrode can be narrowed to reduce the power consumption. However, when dot-sequential driving is performed, the degree of current leakage may differ depending on the position of each pixel, and phenomena including flicker and grainy screen, which is the visual recognition that the display screen appears to be grainy, may be observed. For example, there has been proposed a technique by which the frame frequency is set higher to shorten the period during which current leakage occurs. but further improvement is demanded.

Therefore, an object of the present disclosure is to provide a liquid crystal display device that can reduce irregularities in display due to flicker and the like, and a method for driving the liquid crystal display device.

Solutions to Problems

A liquid crystal display device according to the present disclosure intended to achieve the above-described object includes:

a pixel array unit in which pixels including a liquid crystal cell are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, in which each of the pixels includes a pixel transistor connecting the data line and the pixel electrode, and a conductive state/a non-conductive state of the pixel transistor is controlled by a scan signal voltage applied to the scan line, a signal voltage whose polarity is inverted in regular cycles is supplied to the common wiring, and at least one of a pre-charge voltage supplied to the data line prior to writing of a video signal voltage or a scan signal voltage supplied to the scan line when no pixel is selected is supplied so as to vary in accordance with a position at which the pixels are selected row by row in the pixel array unit.

A method for driving a liquid crystal display device according to the present disclosure intended to achieve the above-described object is a method for driving the liquid crystal display device that includes:

a pixel array unit in which pixels including a liquid crystal cell are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, in which each of the pixels includes a pixel transistor connecting the data line and the pixel electrode, and a conductive state/a non-conductive state of the pixel transistor is controlled by a scan signal voltage applied to the scan Line, and the method includes:

supplying a signal voltage whose polarity is inverted in regular cycles to the common wiring; and supplying at least one of a pre-charge voltage supplied to the data line prior to writing of a video signal voltage or a scan signal voltage supplied to the scan line when no pixel is selected such that the at least one varies in accordance with a position at which the pixels are selected row by row in the pixel array unit.

An electronic apparatus according to the present disclosure intended to achieve the above-described object includes a liquid crystal display device, in which the liquid crystal display device includes:

a pixel array unit in which pixels including a liquid crystal ceil are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, each of the pixels includes a pixel transistor connecting the data line and the pixel electrode, and a conductive state/a non-conductive state of the pixel transistor is controlled by a scan signal voltage applied to the scan line, a signal voltage whose polarity is inverted in regular cycles is supplied to the common wiring, and at least one of a pre-charge voltage supplied to the data line prior to writing of a video signal voltage or a scan signal voltage supplied to the scan line when no pixel is selected is supplied so as to vary in accordance with a position at which the pixels are selected row by row in the pixel array unit.

BRIEF DESCRIPTION OF DRAWINGS

FIG. 3A is a schematic graph for explaining voltage variations due to leakage occurring during AC voltage driving. FIG. 3B is a graph for explaining variations in the absolute value of the pixel potential.

FIG. 6A illustrates a state in which a black window is displayed on a halftone screen. FIG. 6B illustrates a path of current leakage in a pixel. FIG. 6C is a schematic diagram for explaining variations in the pixel potential in pixels $\mathbf{11}_A$, $\mathbf{11}_B$, and $\mathbf{11}_C$ illustrated in FIG. 6A.

FIG. 7A is a schematic graph in a state where a constant pre-charge black voltage is applied during a fixed period. FIG. 7B is a schematic graph in a state where the pre-charge black voltage is applied during a variable period. FIG. 7C is a schematic graph in a state where the pre-charge black voltage is variable.

FIG. 8A is a schematic plan view of a display screen. FIG. 8B is a schematic graph illustrating an in-plane flicker distribution in the case of Vcom-DC driving. FIG. 8C is a schematic graph illustrating an in-plane flicker distribution in the case of Vcom-AC driving. FIG. 8D is a schematic graph illustrating an in-plane flicker distribution in the case of Vcom-AC driving with no pre-charge black voltage supplied.

FIG. 9A is a schematic plan view of a display screen. FIG. 9B is a schematic graph illustrating an in-plane flicker distribution in a case where the scan signal voltage in the scan line varies within [10 volts/−5 volts]. FIG. 9C is a schematic graph illustrating an in-plane flicker distribution in a case where the scan signal voltage in the scan line varies within [10 volts/−3 volts]. FIG. 9D is a schematic graph illustrating an in-plane flicker distribution in a case where the scan signal voltage in the scan line varies within [10 volts/−1 volt].

FIG. 10A shows a front view thereof and FIG. 10B shows a rear view thereof.

MODE FOR CARRYING OUT THE INVENTION

Figure 1:
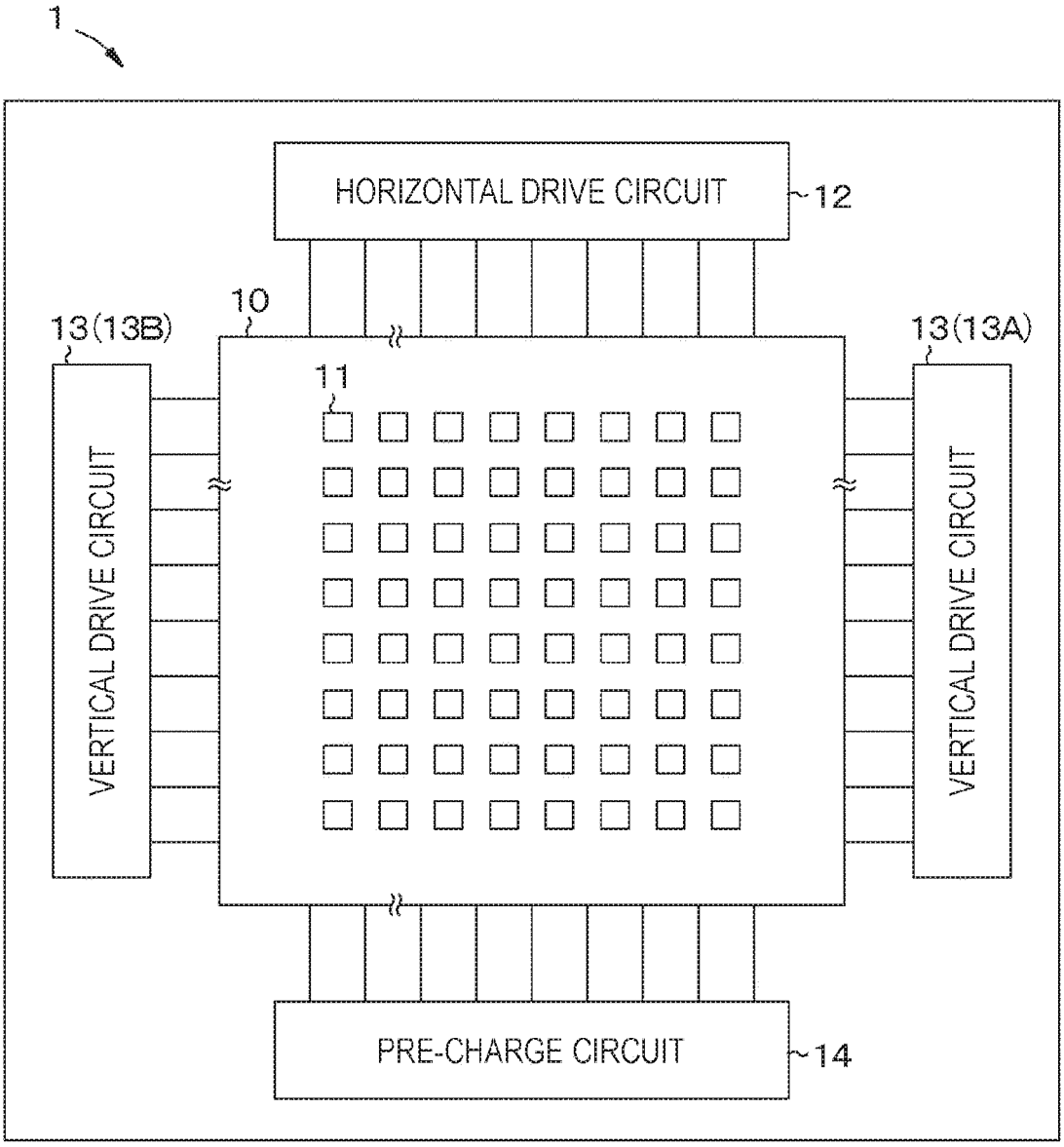
FIG. 1 is a schematic diagram for explaining a liquid crystal display device according to a first embodiment of the present disclosure.

With reference to the drawings, the present disclosure will now fee described on the basis of embodiments. The present disclosure is not limited to the embodiments, and various numerical values and materials in the embodiments are examples. In the following description, the same elements or elements having the same functions will be denoted by the same reference symbols, and redundant descriptions will be omitted. Note that descriptions will be provided in the order mentioned below.

1. General description of liquid crystal display device, method for driving liquid crystal display device, and electronic apparatus according to the present disclosure
2. First embodiment
3. Second embodiment
4. Descriptions of electronic apparatus and others

[General Description of Liquid Crystal Display Device, Method for Driving Liquid Crystal Display Device, and Electronic Apparatus According to the Present Disclosure]

In a configuration of a liquid crystal display device according to the present disclosure, a liquid crystal display device used in an electronic apparatus according to the present disclosure, and a liquid crystal display device driven by a method for driving the liquid crystal display device according to the present disclosure (these nay hereinafter simply be called the present disclosure), a pre-charge voltage supplied to a data line prior to writing of a video signal voltage may be supplied so as to vary in accordance with the position at which pixels are selected row by row in a pixel array unit.

In a configuration in this case, the pre-charge voltage may be supplied so as to vary from row to row in accordance with the position at which pixels in the pixel array unit are selected row by row. In an alternative configuration, a plurality of groups including a plurality of adjacent pixel rows may be formed in the pixel array unit, and the pre-charge voltage may be supplied so as to vary in accordance with the group in which pixels selected row by row are located.

In a configuration according to the present disclosure including various preferred configurations described above, the pre-charge voltage may include a pre-charge black voltage for a black level and a pre-charge gray voltage for a halftone level, and the pre-charge black voltage for the black level may be supplied to the data line in accordance with the position at which pixels are selected row by row. In a configuration in this case, at least one of the value of the pre-charge black voltage for the black level or the period during 3 which the pre-charge black voltage for the black level is applied may be supplied so as to vary in accordance with the position at which pixels are selected row by row.

In an alternative configuration according to the present disclosure including various preferred configuration described above, a scan signal voltage supplied to a scan line when no pixel is selected nay be supplied so as to vary in accordance with the position at which pixels are selected row by row in the pixel array unit.

In a configuration in this case, the scan signal voltage supplied to the scan line when no pixel is selected may be supplied so as to vary in accordance with the position at which the pixels are selected row by row. In an alternative configuration, a plurality of groups including a plurality of adjacent pixel rows may be formed in the pixel array unit, and the scan signal voltage supplied to the scan line when no pixel is selected may be supplied so as to vary in accordance with the group in which pixels selected row by row are located.

The liquid crystal display device may be configured to display a monochrome image or nay be configured to display a color image. Examples of pixel values of the liquid crystal display device may include some image resolutions including, without limitation, O-XGA (1600, 1200), HD-TV (1920, 1080), and O-XGA (2048, 1536), as well as (3840, 2160), (7680, 4320), and the like.

Furthermore, examples of an electronic apparatus equipped with the liquid crystal display device according to the present disclosure include direct-view type or projection type display devices and other various electronic apparatuses having an image display function.

Various conditions herein are satisfied not only when they are strictly satisfied but also when they are substantially satisfied. Various variations that may occur in design or manufacturing are allowed to be present. Furthermore, the individual drawings referred to in the following description are schematic ones, and do not indicate actual dimensions or proportions thereof.

First Embodiment

A first embodiment relates to a liquid crystal display device and a method for driving a liquid crystal display device according to the present disclosure.

Figure 2:
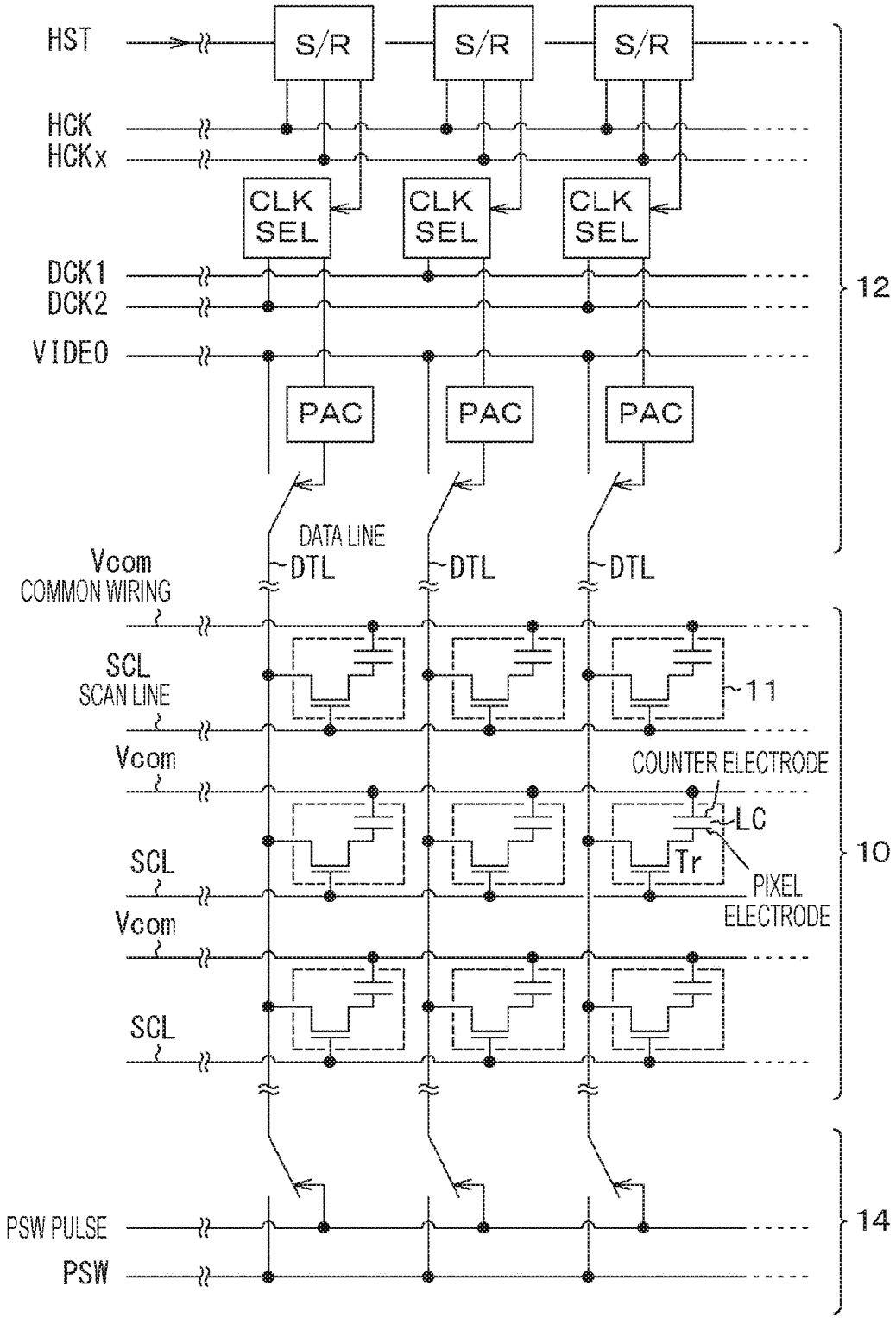
FIG. 2 is a schematic diagram for explaining an internal configuration of the liquid crystal display device.

FIG. 1 is a schematic diagram for explaining a liquid crystal display device according to a first embodiment of the present disclosure. FIG. 2 is a schematic diagram for explaining an internal configuration of the liquid crystal display device.

The liquid crystal display device according to the first embodiment is an active matrix type liquid crystal display device based on a dot-sequential driving method. As illustrated in FIG. 1, the liquid crystal display device 1 includes a pixel array unit 10 in which pixels 11 including a liquid crystal cell are arranged in a matrix, a horizontal drive circuit 12 and a vertical drive circuit 13 for driving the pixel array unit 10, and various circuits including a pre-charge circuit 14. Note that the example illustrated in FIG. 1 shows that the vertical drive circuit 13 is disposed on the right end side and on the left end side of the pixel array unit 10. The circuit on the right end side is denoted by the reference sign 13A, and the circuit on the left end side is denoted by the reference sign 13B.

The pixel array unit 10 includes, for example, a pair of transparent substrates opposed to each other and a liquid crystal layer disposed therebetween, various wiring lines such as scan lines, data lines, and common wiring used for driving the pixels, a pixel electrode disposed in a portion corresponding to a pixel, a counter electrode opposed to the pixel electrode, and a pixel transistor connecting the data line and the pixel electrode. The pixels 11 are arranged in a matrix including, for example, M pixels along the horizontal direction and N pixels along the vertical direction, totaling to M×N pixels.

As illustrate in FIG. 2, in the pixel array unit 10 in which the pixels 11 are arranged in a matrix, there are disposed:

a plurality of scan lines SCL extending along the row direction for selecting the pixels 11 row by row;

common wiring Vcom for supplying a voltage to the counter electrode in a liquid crystal cell; and a plurality of data lines DTL extending along the column direction for supplying a voltage to the pixel electrode in a liquid crystal cell. In addition, each pixel 11 includes a pixel transistor Tr that connects the data line DTL and the pixel electrode.

The scan lines SCL and the common wiring Vcom are driven by the vertical drive circuits 13 (13A, 13B) illustrated in FIG. 1. The conductive state/non-conductive state of the pixel transistor Tr in the pixel 11 illustrated in FIG. 2 is controlled by a scan signal voltage applied to the scan line SCL. As described later, a common voltage whose polarity is inverted in regular cycles is supplied to the common wiring Vcom.

The data lines DTL are driven by the horizontal drive circuit 12 illustrated in FIG. 1. As illustrated in FIG. 2, the horizontal drive circuit 12 includes various circuits such as a shift register (denoted by the symbol S/R), a clock extraction circuit (denoted by the symbol CLKSEL), and a phase adjustment circuit (denoted by the symbol PAC). In addition, the horizontal drive circuit 12 operates on the basis of various clocks supplied from the outside, such as a horizontal start pulse HST, horizontal clock pulses HCK and HCKx, and dual clock pulses DCK1 and DCK2, and performs operations including writing a video signal voltage in a dot-sequential manner via the data lines DTL to pixels selected row by row.

In addition, the data lines DTL are also driven by the pre-charge circuit 14 illustrated in FIG. 1. As illustrated in FIG. 2, the pre-charge circuit 14 operates in synchronization with PSN pulses, and basically performs operations including writing a pre-charge voltage from a pre-charge voltage supply line PSW to the data line DTL prior to writing of a video signal voltage.

In the liquid crystal display device according to the present disclosure, at least one of the pre-charge voltage supplied to the data line DTL prior to writing of a video signal voltage or the scan signal voltage supplied to the scan line SCL when no pixel 11 is selected is supplied so as to vary in accordance with the position at which the pixels 11 are selected row by row in the pixel array unit 10. More specifically, in the first embodiment, the pre-charge voltage supplied to the data line DTL prior to writing of a video signal voltage is supplied so as to vary in accordance with the position at which the pixels 11 are selected row by row in the pixel array unit 10.

Figure 3A:
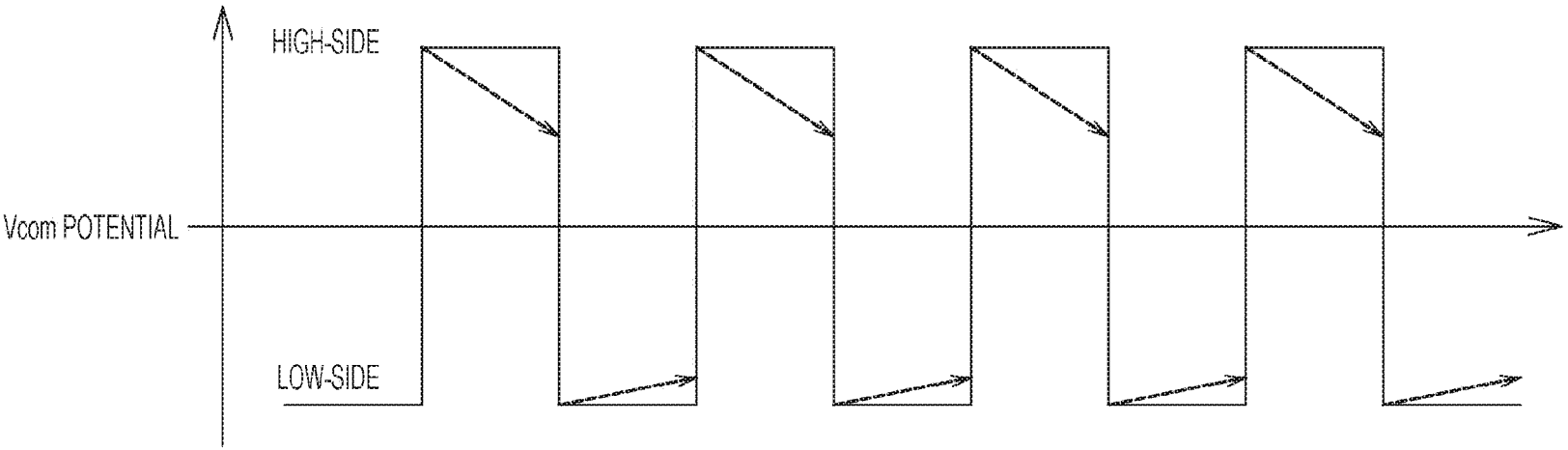
FIGS. 3A and 3B are schematic graphs for explaining a cause of flicker.
Figure 3B:
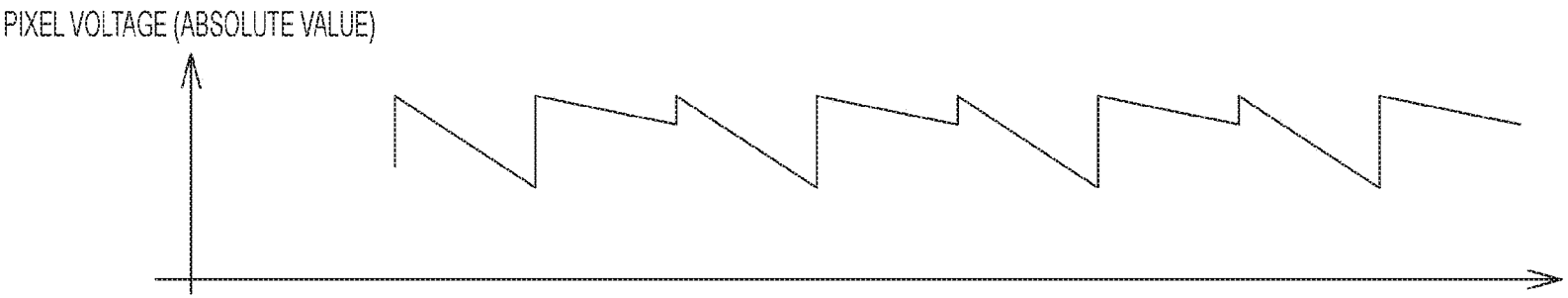
Figure 4:
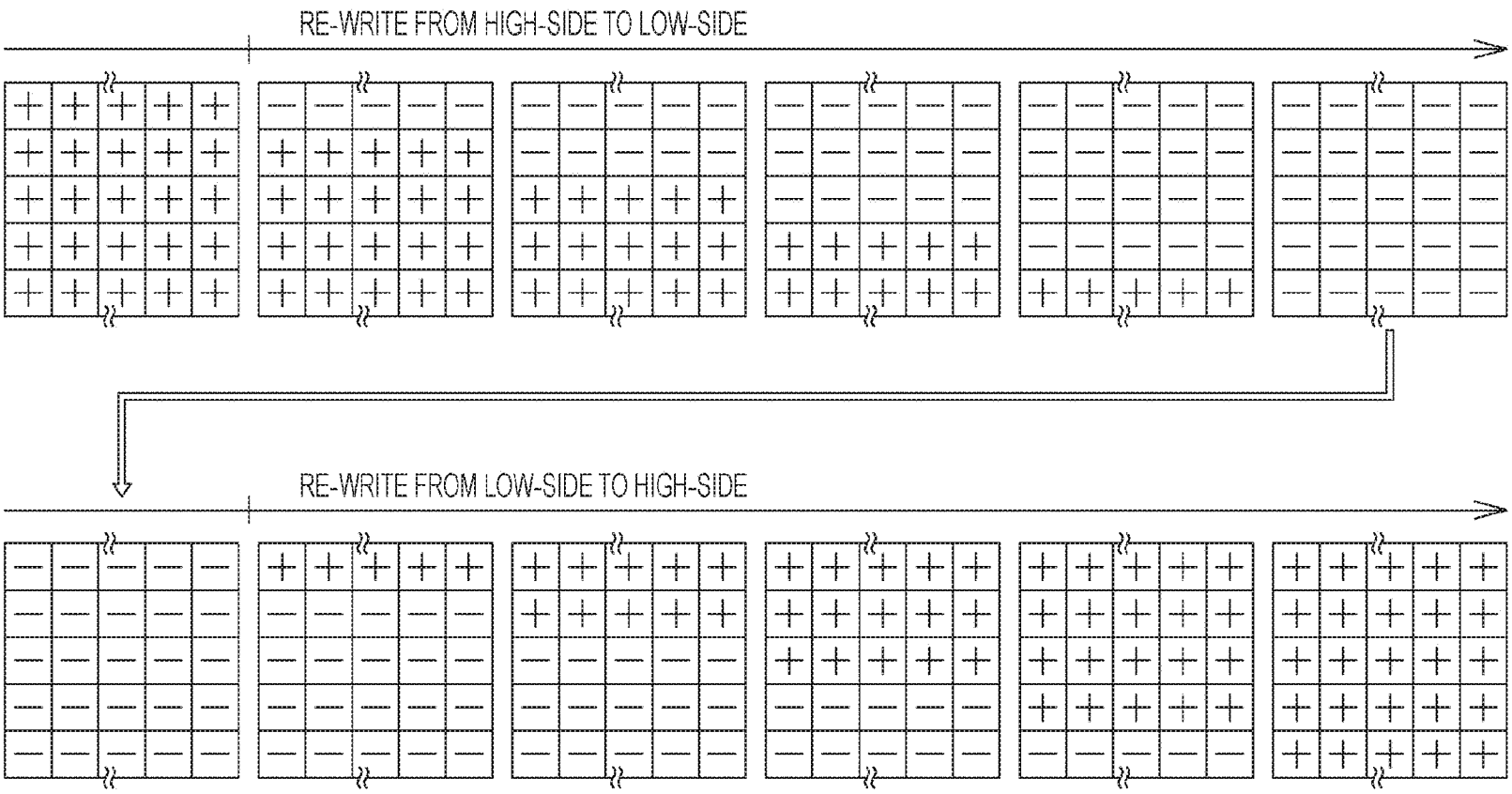
FIG. 4 is a schematic diagram for explaining a cause of grainy screen, which is the visual recognition that the display screen appears to be grainy.

Here, in order to help understand the present disclosure, referring to FIGS. 3 and 4, the following describes causes of the flicker, which is the visual recognition that the screen appears to shine unsteadily and of the grainy screen, which is the visual recognition that the display screen appears to be grainy. Note that, for ease of understanding, the following description assures that the value of the voltage Vcom applied to the counter electrode is fixed.

FIGS. 3A and 3B are schematic graphs for explaining a cause of flicker. FIG. 3A is a schematic graph for explaining voltage variations due to leakage occurring during AC voltage driving. FIG. 3B is a graph for explaining variations in the absolute value of the pixel potential.

As described above, the liquid crystal display device 1 employs AC voltage driving to drive the device by applying an AC voltage. The pixel transistor Tr in the pixel 11 illustrated in FIG. 2 is turned into the non-conductive state after a video signal voltage is written to the pixel electrode. In practice, however, current leakage occurs through the pixel transistor Tr and the potential of the pixel electrode is changed. Here, the source/drain voltage in the pixel transistor Tr differs between a case where the written voltage is on the high potential side (HIGH side) and a case where the written voltage is on the low potential side (LOW side), and different current leakages occur through the pixel transistor Tr. The example illustrated in FIG. 3A shows a case where the written voltage on the HIGH side causes a larger leakage than the written voltage on the LOW aide. In this example, the absolute value of the pixel potential with respect to the Vcom potential varies as shown in FIG. 3B. As a result, such variations are visually recognized as flicker on the screen.

FIG. 4 is a schematic diagram for explaining a cause of grainy screen, which is the visual recognition that the display screen appears to be grainy.

In the case of performing AC voltage driving in the dot-sequential active matrix mode, after a HIGH-side voltage is written to all the pixel electrodes in the pixel array unit in a certain frame, pixel rows are sequentially selected to write a LOW-side voltage sequentially through the data lines. As a result, as a row in the pixel array unit is lower in the order of scanning, a voltage having the polarity opposite to that of the voltage held in the pixel electrode is applied to the data line for a longer period while the pixel transistor Tr is in the non-conductive state. Consequently, the amount of current leakage through the pixel transistor Tr varies depending on the order in which the pixels are selected, resulting in the visual recognition that the display screen appears to be grainy.

Causes of occurrence of flicker and grainy screen have been described above.

The flicker and grainy screen described above can be qualitatively suppressed by reducing the amount of current leakage via the pixel transistor Tr. For this reason, it has been proposed to shorten the duration of current leakage by increasing the frame frequency. For example, on the basis of the reference period over which the pixel electrode holds a voltage at a frame frequency of 60 Hz, the period over which the pixel electrode holds a voltage at a frame frequency of 180 Hz is shorten to about one third, and the period over which the pixel electrode holds a voltage at a frame frequency of 240 Hz is shorten to about a quarter. However, as the frame frequency is increased, more power is consumed by the circuit that drives the pixel array unit. For this reason, so-called Vcom inversion driving, which can reduce the amplitude of a video signal voltage, is often used in addition to the high frame rate driving.

Figure 5:
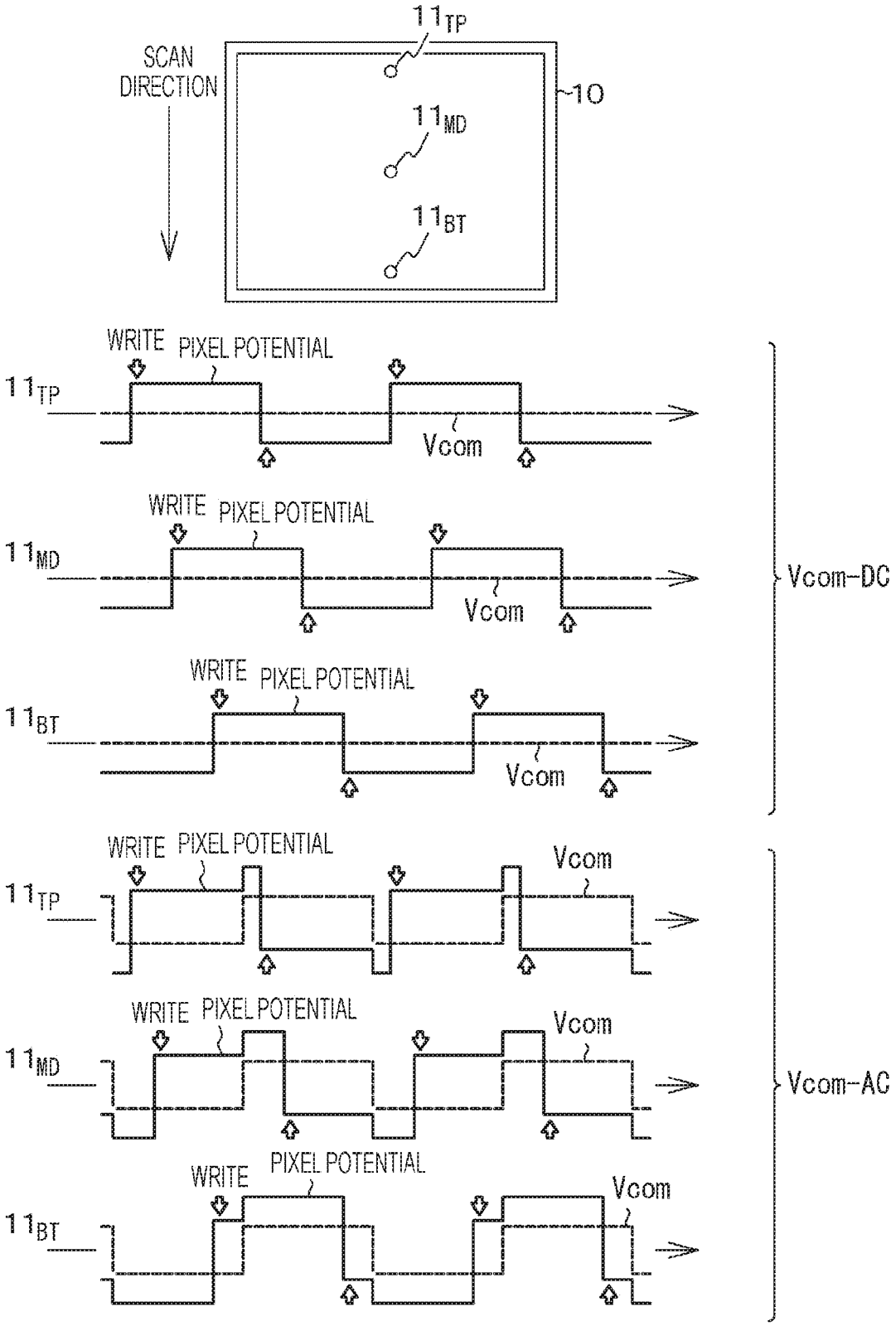
FIG. 5 is a schematic graph for explaining variations in the pixel potential during constant Vcom driving (Vcom-DC driving) and during inverted Vcom driving (Vcom-AC driving).

FIG. 5 is a schematic graph for explaining variations in the pixel potential during constant Vcom driving (Vcom-DC driving) and during inverted Vcom driving (Vcom-AC driving).

As shown in the upper diagram in FIG. 5, in the pixel array unit 10, a pixel in the top portion, a pixel in the middle portion, and a pixel in the bottom portion are denoted as a pixel $\mathbf{11}_{TP}$, a pixel $\mathbf{11}_{MD}$, and a pixel $\mathbf{11}_{BT}$, respectively. In the case of the constant Vcom driving, there is no change in the potential of the pixel electrode (pixel potential) due to variations in the Vcom potential after a voltage from the data line DTL is written to the pixel electrode. Therefore, the state in which the potential is held in the pixel electrode is substantially similar in any of the pixel in the top portion, the pixel in the middle portion, and the pixel in the bottom portion of the pixel array unit.

In contrast, in the case of the inverted Vcom driving, the potential of the pixel electrode (pixel potential) changes due to variations in the Vcom potential after a voltage from the data line DTL is written to the pixel electrode. In addition, the degree of the potential change after a voltage from the data line DTL is written to the pixel electrode varies depending on the position of the pixel in a series of pixels to be scanned. Specifically, of the period over which the pixel electrode holds a voltage, the proportion of the period over which the potential of the pixel electrode changes due to variations in the Vcom potential increases in the order of pixel $\mathbf{11}_{TP}$<pixel $\mathbf{11}_{MD}$<pixel $\mathbf{11}_{BT}$.

The high frame rate driving makes it less likely that the flicker itself is visually recognized. However, a phenomenon like the asymmetric current leakage still remains and the degree of such phenomenon is not uniform over the panel surface, and therefore, observations including the visual recognition of a bright portion and a dark portion in part of the screen may be made.

For this reason, in the liquid crystal display device according to the first embodiment, the pre-charge voltage supplied to the data line prior to writing of a video signal voltage is supplied so as to vary in accordance with the position at which the pixels are selected row by row in the pixel array unit.

The pre-charge voltage includes, for example, a pre-charge black voltage for a black level and a pre-charge gray voltage for a halftone level. The pre-charge black voltage for a black level is a voltage applied to the data line to reduce the so-called vertical crosstalk. In addition, the pre-charge gray voltage for a halftone level is a voltage applied to the data line in order to reduce variations in the potential attained when a video signal voltage is supplied to the data line. In addition, in the liquid crystal display device according to the first embodiment, at least one of the value of the pre-charge black voltage for a black level or the period during which the pre-charge black voltage for a black level is applied is supplied so as to vary in accordance with the position at which pixels are selected row by row.

To aid in understanding, the following describes the so-called vertical crosstalk and the pre-charge voltage.

Figure 6A:
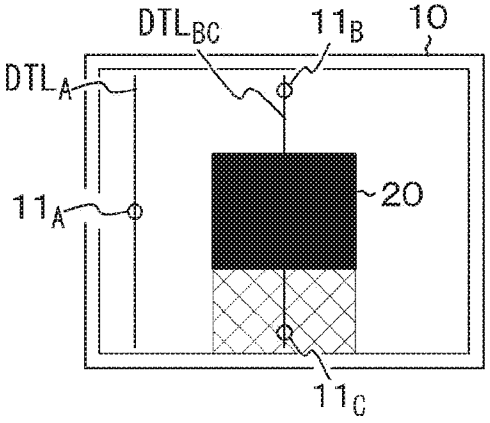
FIGS. 6A, 6B, and 6C are diagrams for explaining vertical crosstalk.
Figure 6B:
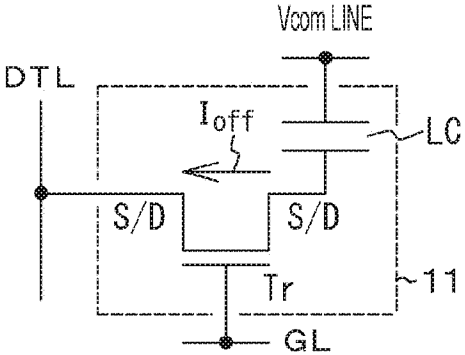
Figure 6C:
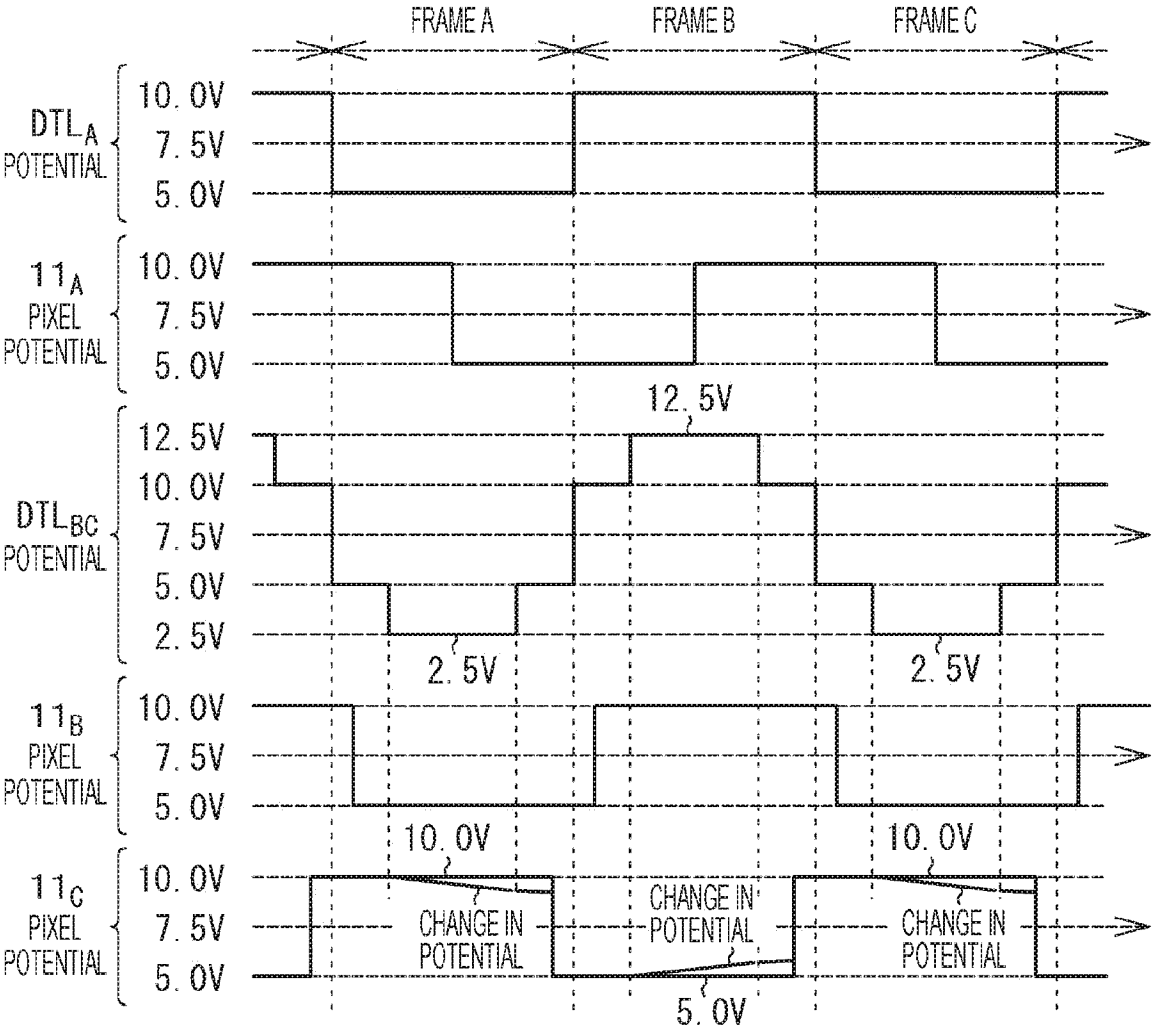

FIGS. 6A, 6B, and 6C are diagrams for explaining vertical crosstalk. FIG. 6A illustrates a state in which a black window is displayed on a halftone screen. FIG. 6B illustrates a path of current leakage in a pixel. FIG. 6C is a schematic diagram for explaining variations in the pixel potential in pixels $\mathbf{11}_A$, $\mathbf{11}_B$, and $\mathbf{11}_C$ illustrated in FIG. 6A. Note that, for ease of understanding, the following description assumes that the value of Vcom is fixed.

The pixel $\mathbf{11}_A$ is a pixel outside the area of a black window 20. In addition, a video signal voltage is supplied to the pixel $\mathbf{11}_A$ via the data line $DTL_A$. Furthermore, other pixels connected to the data line $DTL_A$ are also outside the area of the black window 20. Therefore, as the halftone potential, a voltage of 10.0 volts on the HIGH side and 5.0 volts on the LOW side is sequentially supplied to the data line $DTL_A$ connected to the pixel $\mathbf{11}_A$.

The pixels $\mathbf{11}_B$ and $\mathbf{11}_C$ are also outside the area of the black window 20. Video signal voltages are supplied to the pixels $\mathbf{11}_B$ and $\mathbf{11}_C$ via the data line $DTL_{BC}$. However, some of other pixels connected to the data line $DTL_{BC}$ are inside the area of the black window 20. Accordingly, to the data line $DTL_{BC}$ connected to the pixels $\mathbf{11}_B$ and $\mathbf{11}_C$, voltages of 12.5 volts on the HIGH side and 2.5 volts on the LOW side as the potential for a black level, in addition to 10.0 volts on the HIGH side and 5.0 volts on the LOW side as the potential for a halftone, are sequentially supplied.

Basically, the current leakage in the pixel transistor Tr is larger as the voltage $V_{ds}$ between one source/drain region connected to the pixel electrode and the other source/drain region connected to the data line DTL is higher.

In the pixel $\mathbf{11}_B$, a voltage of 5.0 volts on the LOW aide is written as the potential for a halftone near the beginning of a frame A. After the pixel $\mathbf{11}_B$ is in the non-selection state, the potential of the data line $DTL_{BC}$ changes from halftone 5,0 volts to black level 2.5 volts and to halftone 5,0 volts.

In this case, when the data line $DTL_{BC}$ is at a voltage of black level 2.5 volts, the voltage $V_{ds}$ in the pixel transistor Tr in the pixel $\mathbf{11}_B$ may be 2.5 volts.

On the other hand, in the pixel $\mathbf{11}_C$, a voltage of 10.0 volts on the HIGH side is written as the potential for a halftone near the end of the frame immediately before the frame A. Then, 5.0 volts on the LOW side is written near the end of the frame A.

In this case, when the data line $DTL_{BC}$ is at a voltage of black level 2.5 volts, the voltage $V_{ds}$ in the pixel transistor Tr in the pixel $\mathbf{11}_C$ may be 7.5 volts. Therefore, when the data line $DTL_{BC}$ is at black level 2.5 volts, the current leakage in the pixel $\mathbf{11}_C$ is greater than in the pixel $\mathbf{11}_B$. For this reason, luminance change is remarkable particularly in a halftone portion located under the black window 20.

In order to reduce the above-described luminance change, all the pixels in the pixel array unit are only required to have approximately the same amount of leakage. By supplying a black level pre-charge voltage to the data line DTL within a period when writing of a video signal voltage is unaffected, pixels including the pixels with relatively small current leakage are urged to cause leakage, whereby phenomena including vertical crosstalk can be reduced. Furthermore, by applying a halftone level pre-charge voltage subsequent to the black level pre-charge voltage, variations in the potential attained when a video signal voltage is supplied to the data line can be reduced.

Vertical crosstalk and pre-charge voltages have been described above.

As described above, in the first embodiment, the pre-charge voltage supplied to the data line prior to writing of a video signal voltage is supplied so as to vary in accordance with the position at which the pixels are selected row by row in the pixel array unit.

Figure 7A:
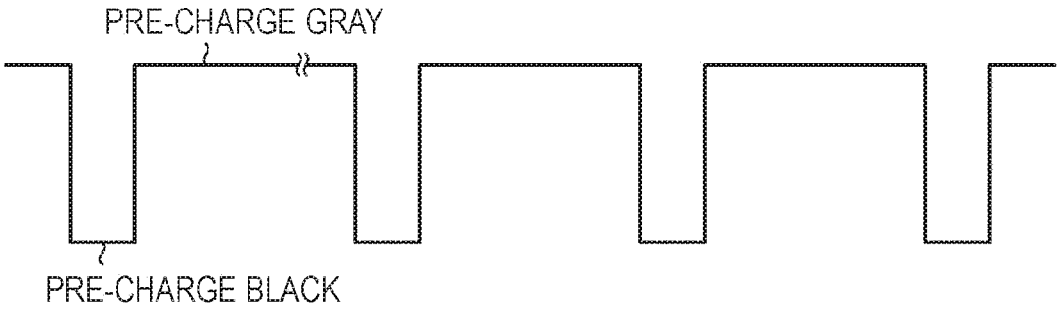
FIGS. 7A, 7B, and 7C are schematic graphs illustrating a pre-charge gray voltage and a pre-charge black voltage.
Figure 7B:
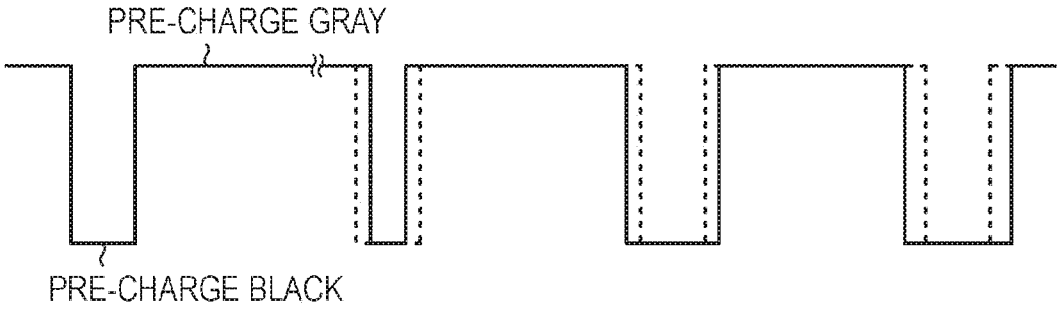
Figure 7C:
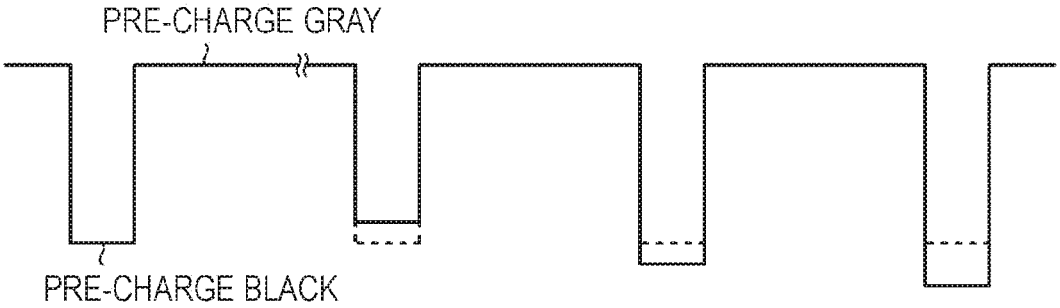

FIGS. 7A, 7B, and 7C are schematic graphs illustrating a pre-charge gray voltage and a pre-charge black voltage. FIG. 7A is a schematic graph in a state where a constant pre-charge black voltage is applied during a fixed period. FIG. 7B is a schematic graph in a state where the pre-charge black voltage is applied during a variable period. FIG. 7C is a schematic graph in a state where the pre-charge black voltage is variable.

Figure 8A:
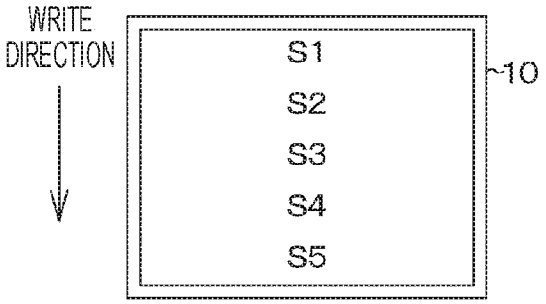
FIGS. 8A, 8B, 8C and 8D are diagrams for explaining an example of an in-plane flicker distribution.
Figure 8B:
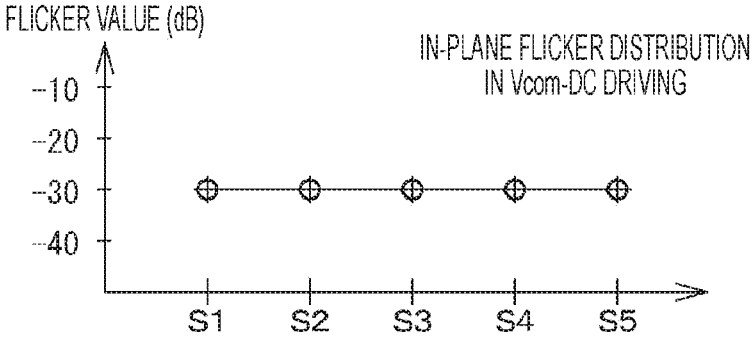
Figure 8C:
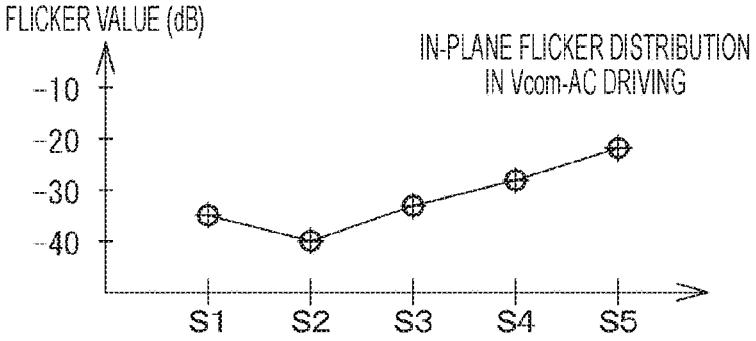
Figure 8D:
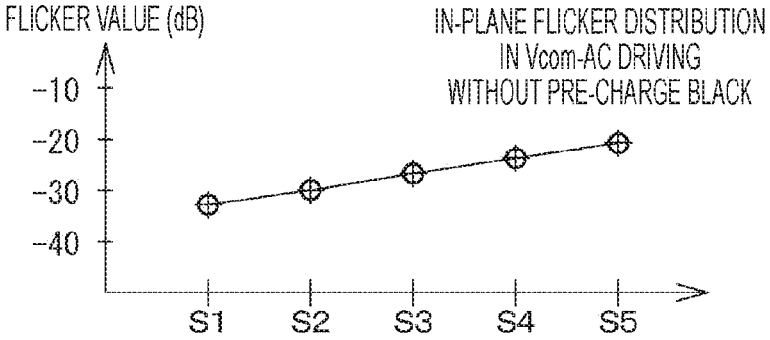

FIGS. 8A, 8B, 8C and 8D are diagrams for explaining an example of an in-plane flicker distribution. FIG. 8A is a schematic plan view of a display screen. FIG. 8B is a schematic graph illustrating an in-plane flicker distribution in the case of Vcom-DC driving. FIG. 8C is a schematic graph illustrating an in-plane flicker distribution in the case of Vcom-AC driving. FIG. 8D is a schematic graph illustrating an in-plane flicker distribution in the case of Vcom-AC driving with no pre-charge black voltage supplied.

As described with reference to FIG. 5, in the case of Vcom-DC driving, the state in which the potential is held in the pixel electrode is substantially similar in any of the pixel in the top portion, the pixel in the middle portion, and the pixel in the bottom portion of the pixel array unit. Therefore, as illustrated in FIG. 8B, the flicker is in a substantially constant state regardless of the position in the pixel array unit.

In the case of Vcom-AC driving, however, as described with reference to FIG. 5, the degree of the potential change after a voltage from the data line is written to the pixel electrode varies depending on the position of the pixel in a series of pixels to be scanned. FIG. 8C illustrates flicker occurring when a constant, not variable, pre-charge black voltage is applied during a fixed, not variable, period. In this case, the flicker is locally changed in the area indicated by the symbol S2 in the pixel array, representing the state in which a bright stripe or a dark stripe is visually recognized.

FIG. 8D illustrates the flicker occurring when the pre-charge black voltage in FIG. 8C is omitted. In this case, it is seen that the local change in the area indicated by the symbol S2 in FIG. 8C is mitigated.

As described above, pixel leakage can be urged to be caused by supplying a black level pre-charge voltage to the data line DTL within a period when writing of a video signal voltage is unaffected. Therefore, the amount of pixel leakage in an in-plane pixel can be adjusted by making the value of the pre-charge black potential or the period during which the pre-charge black potential is supplied variable from the area S1, which is the beginning of writing, to the area S5. As a result, local changes in in-plane flicker can be mitigated.

In a configuration, the pre-charge voltage may be supplied so as to vary from row to row in accordance with the position at which the pixels 11 are selected row by row in the pixel array unit 10, or the pre-charge voltage may be supplied so as to vary in accordance with the group in which the pixels 11 selected row by row are located. For example, in a configuration in the latter example for the pixels included in the areas S1 to SS illustrated in FIG. 6A, a certain variable amount nay be uniformly applied to each of the areas S1 to S5 to which the pixels belong.

Note that determining how the pre-charge voltage is to be varied requires, for example, observing the flicker on the actual device in operation and appropriately selecting a condition for mitigating the degree of the flicker.

According to the first embodiment, irregularities in display caused by flicker and the like can be reduced by controlling a pre-charge voltage to make the pre-charge voltage variable.

Second Embodiment

A second embodiment also relates to a liquid crystal display device and a method for driving a liquid crystal display device according to the present disclosure.

In the first embodiment, the pre-charge voltage supplied to the data line prior to writing of a video signal voltage is supplied so as to vary in accordance with the position at which the pixels are selected row by row in the pixel array unit. In contrast, in the second embodiment, a scan signal voltage, which is supplied to a scan line when no pixel is selected, is supplied so as to vary in accordance with the position at which pixels are selected row by row in the pixel array unit.

The configuration of the liquid crystal display device according to the second embodiment is similar to the configuration described in the first embodiment except that the vertical drive circuit operates in a different manner, and thus the description of the configuration is omitted.

In the first embodiment described above, the current leakage in the pixel transistor Tr is increased as the voltage $V_{ds}$ is higher. However, the current leakage is also affected by the value of the voltage applied to the gate electrode when the pixel transistor Tr is not selected. Therefore, the degree of pixel leakage can also be adjusted by making the scan signal voltage supplied to the scan line SCL variable when the pixel 11 is not selected.

Figure 9A:
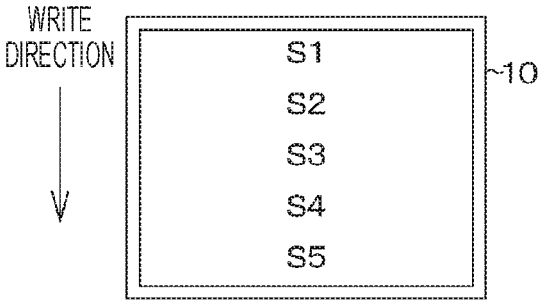
FIGS. 9A, 9B, 9C and 9D are diagrams for explaining an example of an in-plane flicker distribution.
Figure 9B:
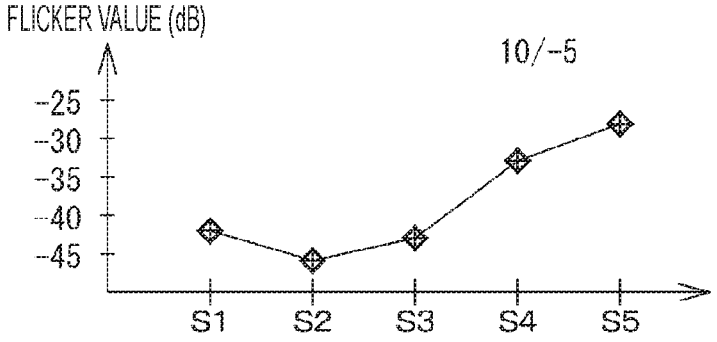
Figure 9C:
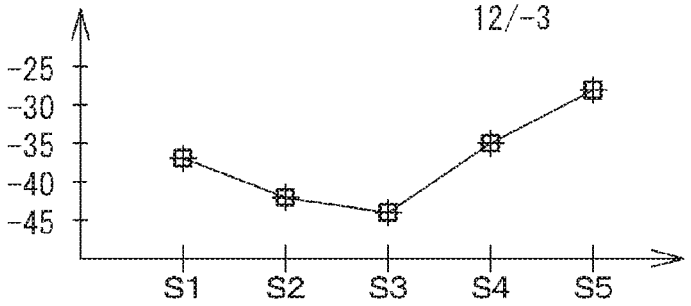
Figure 9D:
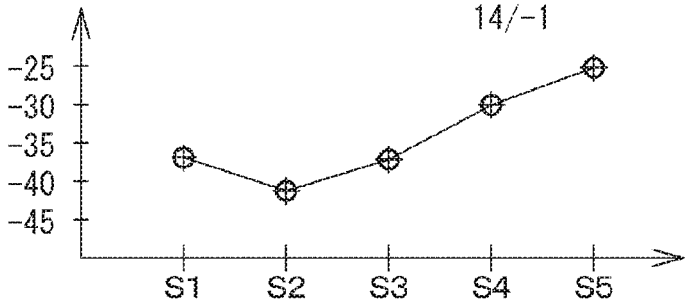

FIGS. 9A, 9B, 9C and 9D are diagrams for explaining an example of an in-plane flicker distribution. FIG. 9A is a schematic plan view of a display screen. FIG. 9B is a schematic graph illustrating an in-plane flicker distribution in a case where the scan signal voltage in the scan line varies within [10 volts/−5 volts]. FIG. 9C is a schematic graph illustrating an in-plane flicker distribution in a case where the scan signal voltage in the scan line varies within [12 volts/−3 volts]. FIG. 9D is a schematic graph illustrating an in-plane flicker distribution in a case where the scan signal voltage in the scan lines varies within [14 volts/−1 volt].

As illustrated in FIGS. 9B to 9D, the distribution of in-plane flicker changes by varying the voltage applied to the gate electrode when the pixel 11 is not selected. Therefore, as in the first embodiment, the in-place flicker can be mitigated so as not to locally change by appropriately setting the voltage to be applied when the pixel 11 is not selected.

In a configuration, the scan signal voltage may be supplied so as to vary from row to row in accordance with the position at which the pixels 11 are selected row by row in the pixel array unit 10, or may be supplied so as to vary in accordance with the group in which the pixels 11 selected row by row are located. For example, in a configuration in the latter example for the pixels included in the areas S1 to S5 illustrated in FIG. 9A, a certain variable amount may be uniformly applied to each of the areas S1 to S5 to which the pixels belong.

Note that determining how the scan signal voltage is to be varied requires, for example, observing the flicker on the actual device in operation and appropriately selecting a condition for mitigating the degree of the flicker.

According to the second embodiment, irregularities in display caused by flicker and the like can be reduced by controlling a scan signal voltage when no pixel is selected to make the scan signal voltage variable.

[Description of Electronic Apparatus]

The liquid crystal display device of the present disclosure described above can be used as a display unit (display device) of an electronic apparatus in any field for displaying video signals input to the electronic apparatus or video signals generated in the electronic apparatus as an image or video. For example, the display device may be used as a display unit in a television set, a digital still camera, a notebook personal computer, a mobile terminal device such as a mobile phone, a video camera, a head-mounted display (a display attached on one's head), and so on.

The display device of the present disclosure may ever, include a module-shaped device in a sealed configuration. An example may be a display module formed by attaching opposed units including transparent glass or the like to the pixel array unit. Note that the display module may be provided with a circuit unit, a flexible printed circuit (FPC), and the like for inputting and outputting signals and the like from the outside to the pixel array unit. As specific examples of an electronic apparatus employing the display device of the present disclosure, a digital still camera and a head-mounted display are exemplified below. Note that, however, the specific examples illustrated here are not restrictive but are merely examples.

Specific Example 1

Figure 10A:
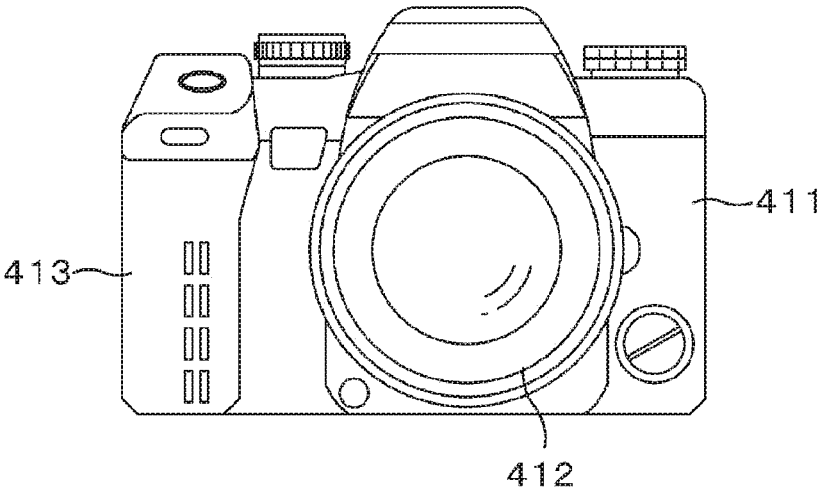
FIGS. 10A and 10B are external views of a lens-interchangeable single-lens reflex type digital still camera.
Figure 10B:
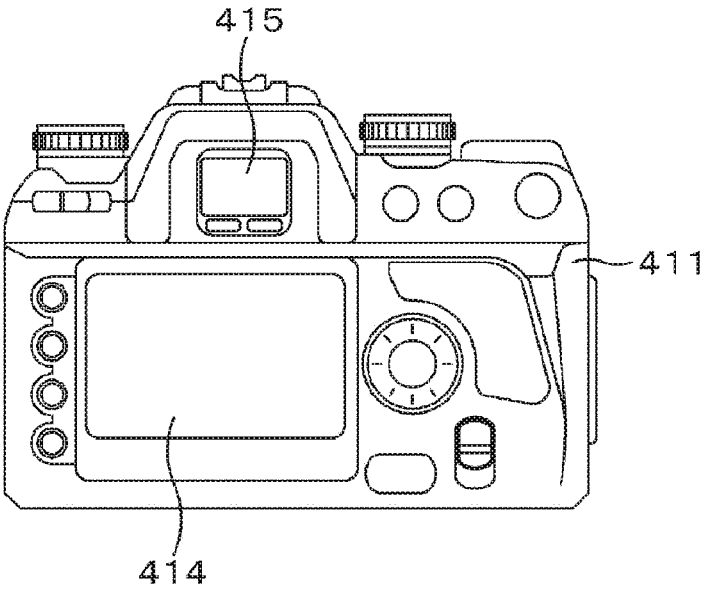

FIGS. 10A and 10B are external views of a lens-interchangeable single-lens reflex type digital still camera. FIG. 10A shows a front view thereof and FIG. 10B shows a rear view thereof. The lens-interchangeable single-lens reflex type digital still camera includes, for example, an interchangeable photographing lens unit (interchangeable lens) 412 on the front right side of a camera main body (camera body) 411 and a grip portion 413 to be gripped by a photographer on the front left side.

In addition, a monitor 414 is disposed substantially in the center of the rear surface of the camera main body 411. A viewfinder (eyepiece window) 415 is disposed above the monitor 414. By looking through the viewfinder 415, the photographer can visually recognize the optical image of the subject guided from the photographing lens unit 412 to determine the composition.

In the lens-interchangeable single-lens reflex type digital still camera as configured above, the display device of the present disclosure can be used as the viewfinder 415. That is, the lens-interchangeable single-lens reflex type digital still camera according to the present example is produced by using the display device of the present disclosure as the viewfinder 415.

Specific Example 2

Figure 11:
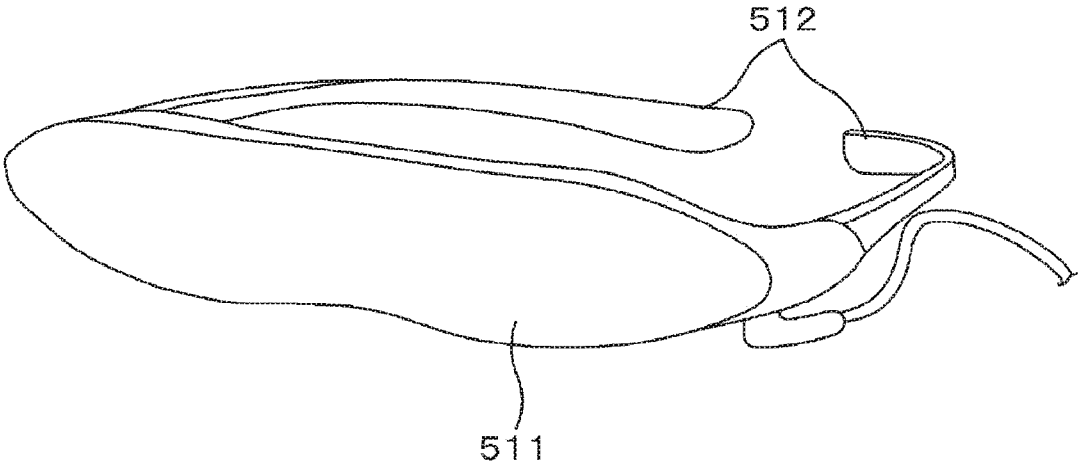
FIG. 11 is an external view of a head-mounted display.

FIG. 11 is an external, view of a head-mounted display. The head-mounted display includes, for example, an ear hook portion 512 on both sides of an eyeglass-shaped display portion 511 so that the head-mounted display is attached on the user's head. In the head-mounted display, the display device of the present disclosure can be used as the display portion 511. That is, the head-mounted display according to the present example is produced by using the display device of the present disclosure as the display portion 511.

Specific Example 3

Figure 12:
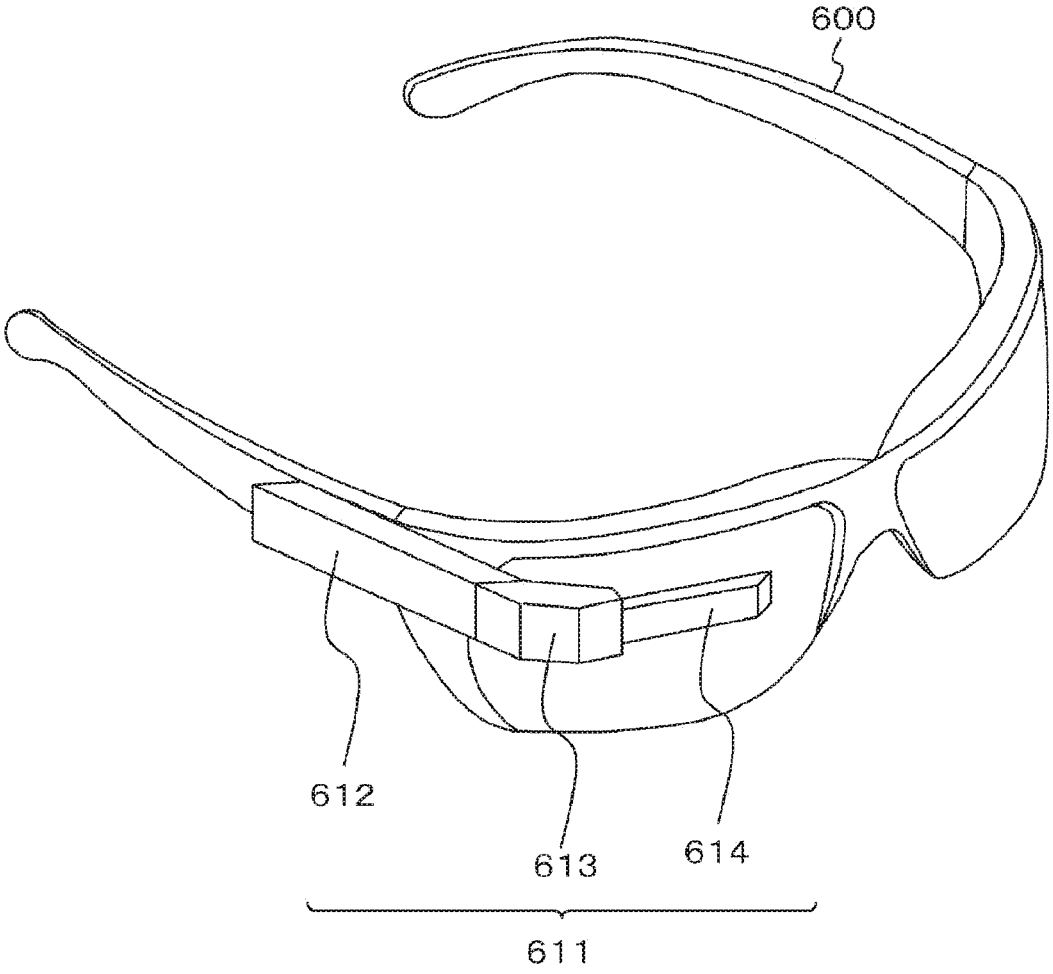
FIG. 12 is an external view of a see-through head-mounted display.

FIG. 12 is an external view of a see-through head-mounted display. The see-through head-mounted display 611 includes a main body 612, an arm 613, and a lens barrel 614.

The main body 612 is connected to the arm 613 and to eyeglasses 600. Specifically, an end of the main body 612 with respect to the long side direction is connected to the arm 613, and one of the side surfaces of the main body 612 is connected to the eyeglasses 600 via a connection member. Note chat the main body 612 may be directly attached on the head of a human body.

The main body 612 contains a control board for controlling operations of the see-through head-mounted display 611 and also contains a display unit. The arm 613 connects the main body 612 and the lens barrel 614 and supports the lens barrel 614. Specifically, the arm 613 is coupled to an end of the main body 612 and to an end of the lens barrel 614 to fix the lens barrel 614. Furthermore, the arm 613 contains a signal line for exchanging data regarding an image provided by the main body 612 to the lens barrel 614.

The lens barrel 614 projects, through an eyepiece, the image light provided by the main body 612 via the arm 613 onto the eyes of the user wearing the see-through head-mounted display 611. In the see-through head-mounted display 611, the display device of the present disclosure can be used as the display unit in the main body 612.

[Others]

Note that the technology of the present disclosure may also have the following configurations.

[A1]

A liquid crystal display device including:

a pixel array unit in which pixels including a liquid crystal cell are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, in which each of the pixels includes a pixel transistor connecting the data line and the pixel electrode, and a conductive state/a non-conductive state of the pixel transistor is controlled by a scan signal voltage applied to the scan line, a signal voltage whose polarity is inverted in regular cycles is supplied to the common wiring, and at least one of a pre-charge voltage supplied to the data line prior to writing of a video signal voltage or a scan signal voltage supplied to the scan line when no pixel is selected is supplied so as to vary in accordance with a position at which the pixels are selected row by row in the pixel array unit.

[A2]

The liquid crystal display device according to [A1] above, in which the pre-charge voltage is supplied so as to vary in accordance with the position at which the pixels are selected row by row in the pixel array unit.

[A3]

The liquid crystal display device according to [A2] above, in which the pre-charge voltage is supplied so as to vary from row to row in accordance with the position at which the pixels are selected row by row in the pixel array unit.

[A4]

The liquid crystal display device according to [A2] above, in which a plurality of groups including a plurality of adjacent pixel rows is formed in the pixel array unit, and the pre-charge voltage is supplied so as to vary in accordance with a group in which the pixels selected row by row are located.

[A5]

The liquid crystal display device according to any of [A2] to [A4] above, in which the pre-charge voltage includes a pre-charge black voltage for a black level and a pre-charge gray voltage for a halftone level, and the pre-charge black voltage for the black level in accordance with the position at which the pixels are selected row by row is supplied to the data line.

[A6]

The liquid crystal display device according to [A5] above, in which at least one of a value of the pre-charge black voltage for the black level or a period during which the pre-charge black voltage for the black level is applied is supplied so as to vary in accordance with the position at which the pixels are selected row by row.

[A7]

The liquid crystal display device according to [A1] above, in which the scan signal voltage supplied to the scan line when no pixel is selected is supplied so as to vary in accordance with the position at which the pixels are selected row by row in the pixel array unit.

[A8]

The liquid crystal display device according to [A7] above, in which the scan signal voltage supplied to the scan line when no pixel is selected is supplied so as to vary in accordance with the position at which the pixels are selected row by row.

[A9]

The liquid crystal display device according to [A7] above, in which a plurality of groups including a plurality of adjacent pixel rows is formed in the pixel array unit, and the scan signal voltage supplied to the scan line when no pixel is selected is supplied so as to vary in accordance with a group in which the pixels selected row by row are located.

[B1]

A method for driving a liquid crystal display device including:

a pixel array unit in which pixels including a liquid crystal cell are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, in which each of the pixels includes a pixel transistor connecting the data line and the pixel electrode, and a conductive state/a non-conductive state of the pixel transistor is controlled by a scan signal voltage applied to the scan line, and the method includes:

supplying a signal voltage whose polarity is inverted in regular cycles to the common wiring; and supplying at least one of a pre-charge voltage supplied to the data line prior to writing of a video signal voltage or a scan signal voltage supplied to the scan line when no pixel is selected such that the at least one varies in accordance with a position at which the pixels are selected row by row in the pixel array unit.

[B2]

The method for driving the liquid crystal display device according to [B1] above, the method including:

supplying the pre-charge voltage such that the pre-charge voltage varies in accordance with the position at which the pixels are selected row by row in the pixel array unit.

[B3]

The method for driving the liquid crystal display device according to [B2] above, the method including:

supplying the pre-charge voltage such that the pre- charge voltage varies from row to row in accordance with the position at which the pixels are selected row by row in the pixel array unit.

[B4]

The method for driving the liquid crystal display device according to [B2] above, in which:

a plurality of groups including a plurality of adjacent pixel rows is formed in the pixel array unit, and the method includes supplying the pre-charge voltage such that the pre-charge voltage varies in accordance with a group in which the pixels selected row by row are located.

[B5]

The method for driving the liquid crystal display device according to any of [B2] to [B4] above, in which:

the pre-charge voltage includes a pre-charge black voltage for a black level and a pre-charge gray voltage for a halftone level, and the method includes supplying the pre-charge black voltage for the black level in accordance with the position at which the pixels are selected row by row to the data line.

[B6]

The method for driving the liquid crystal display device according to [B5] above, the method including:

supplying at least one of a value of the pre-charge black voltage for the black level or a period during which the pre-charge black voltage for the black level is applied such that the at least one varies in accordance with the position at which the pixels are selected row by row.

[B7]

The method for driving the liquid crystal display device according to [B1] above, the method including:

supplying the scan signal voltage supplied to the scar, line when no pixel is selected such that the scan signal voltage varies in accordance with the position at which the pixels are selected row by row in the pixel array unit.

[B8]

The method for driving the liquid crystal display device according to [B7] above, the method including:

supplying the scan signal voltage supplied to the scan line when no pixel is selected such that the scan signal voltage varies in accordance with the position at which the pixels are selected row by row.

[B9]

The method for driving the liquid crystal display device according to [B7] above, in which a plurality of groups including a plurality of adjacent pixel rows is formed in the pixel array unit, and the method includes supplying the scan signal voltage supplied to the scan line when no pixel is selected such that the scan signal voltage varies in accordance with a group in which the pixels selected row by row are located.

[C1]

An electronic apparatus including a liquid crystal display device, in which the liquid crystal display device includes:

a pixel array unit in which pixels including a liquid crystal cell are arranged in a matrix;

a plurality of scan lines that selects the pixels row by row, the plurality of scan lines extending along a row direction;

conation wiring that supplies a voltage to a counter electrode in the liquid crystal cell; and a plurality of data lines that supplies a voltage to a pixel electrode in the liquid crystal cell, the plurality of data lines extending along a column direction, each of the pixels includes a pixel transistor connecting the data line and the pixel electrode, and a conductive state/a non-conductive state of the pixel transistor is controlled by a scan signal voltage applied to the scan line, a signal voltage whose polarity is inverted in regular cycles is supplied to the common wiring, and at least one of a pre-charge voltage supplied to the data line prior to writing of a video signal voltage or a scan signal voltage supplied to the scan line when no pixel is selected is supplied so as to vary in accordance with a position at which the pixels are selected row by row in the pixel array unit.

[C2]

The electronic apparatus according to [C1] above, in which the pre-charge voltage is supplied so as to vary in accordance with the position at which the pixels are selected row by row in the pixel array unit.

[C3]

The electronic apparatus according to [C2] above, in which the pre-charge voltage is supplied so as to vary from row to row in accordance with the position at which the pixels are selected row by row in the pixel array unit.

[C4]

The electronic apparatus according to [C2] above, in which a plurality of groups including a plurality of adjacent pixel rows is formed in the pixel array unit, and the pre-charge voltage is supplied so as to vary in accordance with a group in which the pixels selected row by row are located.

[C5]

The electronic apparatus according to any of [C2] to [C4] above, in which the pre-charge voltage includes a pre-charge black voltage for a black level and a pre-charge gray voltage for a halftone level, and the pre-charge black voltage for the black level in accordance with the position at which the pixels are selected row by row is supplied to the data line.

[C6]

The electronic apparatus according to [C5] above, in which at least one of a value of the pre-charge black voltage for the black level or a period during which the pre-charge black voltage for the black level is applied is supplied so as to vary in accordance with the position at which the pixels are selected row by row.

[C7]

The electronic apparatus according to [C1] above, in which the scan signal voltage supplied to the scan line when no pixel is selected is supplied so as to vary in accordance with the position at which the pixels are selected row by row in the pixel array unit.

[C8]

The electronic apparatus according to [C7] above, in which the scan signal voltage supplied to the scan line when no pixel is selected is supplied so as to vary in accordance with the position at which the pixels are selected row by row.

[C9]

The electronic apparatus according to [C7] above, in which a plurality of groups including a plurality of adjacent pixel rows is formed in the pixel array unit, and the scan signal voltage supplied to the scan line when no pixel is selected is supplied so as to vary in accordance with a group in which the pixels selected row by row are located.

REFERENCE SIGNS LIST

1 Liquid crystal display device
10 Pixel array unit
11 Pixel
12 Horizontal drive circuit
13, 13A, 13B Vertical drive circuit
14 Pre-charge circuit

20 Black window
LC Liquid crystal cell
Tr Pixel transistor
DTL Data line
SCL Scan line
Vcom Common wiring
PSW Pre-charge voltage supply line
411 Camera main body
412 Photographing lens unit
413 Grip portion
414 Monitor
415 Viewfinder
511 Eyeglass-shaped display portion
512 Ear hook portion
600 Eyeglasses
611 See-through head-mounted display
612 Main body
613 Arm
614 Lens barrel

What is claimed is:

1. A liquid crystal display device, comprising:

a pixel array unit in which pixels including a liquid crystal cell are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, wherein each of the pixels includes a pixel transistor connecting a data line in the plurality of data lines and the pixel electrode, and a conductive state/a non-conductive state of the pixel transistor is controlled by a scan signal voltage applied to a scan line of the plurality of scan lines, wherein a signal voltage whose polarity is inverted in regular cycles is supplied to the common wiring, and wherein a scan signal voltage supplied to the scan line of the plurality of scan lines when no pixel is selected is supplied so as to vary between a positive voltage value and a negative voltage value, with the positive voltage value being at least twice that of the negative voltage value, in accordance with a position at which the pixels are selected row by row in the pixel array unit.

2. The liquid crystal display device according to claim 1, wherein the scan signal voltage supplied to the scan line of the plurality of scan lines when no pixel is selected is supplied so as to vary in accordance with the position at which the pixels are selected row by row.

3. The liquid crystal display device according to claim 1, wherein a plurality of groups including a plurality of adjacent pixel rows is formed in the pixel array unit, and the scan signal voltage supplied to the scan line of the plurality of scan lines when no pixel is selected is supplied so as to vary in accordance with a group of the plurality of groups in which the pixels selected row by row are located.

4. A method for driving a liquid crystal display device comprising:

a pixel array unit in which pixels including a liquid crystal cell are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, wherein each of the pixels includes a pixel transistor connecting a data line in the plurality of data lines and the pixel electrode, and wherein a conductive state/a non-conductive state of the pixel transistor is controlled by a scan signal voltage applied to a scan line of the plurality of scan lines, the method comprises:

supplying a signal voltage whose polarity is inverted in regular cycles to the common wiring; and supplying a scan signal voltage supplied to the scan line of the plurality of scan lines when no pixel is selected such that the scan signal voltage varies, between a positive voltage value and a negative voltage value, with the positive voltage value being at least twice that of the negative voltage value, in accordance with a position at which the pixels are selected row by row in the pixel array unit.

5. The method for driving a liquid crystal display device according to claim 4, further comprising supplying the scan signal voltage supplied to the scan line of the plurality of scan lines when no pixel is selected such that the scan signal voltage varies in accordance with a position at which the pixels are selected row by row.

6. The method for driving a liquid crystal display device according to claim 4, further comprising:

forming a plurality of groups including a plurality of adjacent pixel rows in the pixel array unit, and supplying the scan signal voltage supplied to the scan line of the plurality of scan lines when no pixel is selected so as to vary in accordance with a group of the plurality of groups in which the pixels selected row by row are located.

7. An electronic apparatus, comprising:

a liquid crystal display device, wherein the liquid crystal display device comprises:

a pixel array unit in which pixels including a liquid crystal cell are arranged in a matrix;

a plurality of scan lines that selects the pixels row by row, the plurality of scan lines extending along a row direction;

common wiring that supplies a voltage to a counter electrode in the liquid crystal cell; and a plurality of data lines that supplies a voltage to a pixel electrode in the liquid crystal cell, the plurality of data lines extending along a column direction, wherein each of the pixels includes a pixel transistor connecting a data line in the plurality of data lines and the pixel electrode, and a conductive state/a non-conductive state of the pixel transistor is controlled by a scan signal voltage applied to a scan line of the plurality of scan lines, wherein a signal voltage whose polarity is inverted in regular cycles is supplied to the common wiring, and wherein a scan signal voltage supplied to the scan line of the plurality of scan lines when no pixel is selected is supplied so as to vary, between a positive voltage value and a negative voltage value, with the positive voltage value being at least twice that of the negative voltage value, in accordance with a position at which the pixels are selected row by row in the pixel array unit.

8. The electronic apparatus according to claim 7, wherein the scan signal voltage supplied to the scan line of the plurality of scan lines when no pixel is selected is supplied so as to vary in accordance with the position at which the pixels are selected row by row.

9. The electronic apparatus according to claim 7, wherein a plurality of groups including a plurality of adjacent pixel rows is formed in the pixel array unit, and the scan signal voltage supplied to the scan line of the plurality of scan lines when no pixel is selected is supplied so as to vary in accordance with a group of the plurality of groups in which the pixels selected row by row are located.

* * * * *